US006766564B2

(12) United States Patent
Pferdmenges

(10) Patent No.: US 6,766,564 B2
(45) Date of Patent: Jul. 27, 2004

(54) DEVICE FOR ATTACHING CLOTHING TO A FLAT BAR

(75) Inventor: Gerd Pferdmenges, Jüchen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/391,014

(22) Filed: Mar. 19, 2003

(65) Prior Publication Data

US 2003/0182765 A1 Oct. 2, 2003

(30) Foreign Application Priority Data

Mar. 30, 2002 (DE) ..... 102 14 391

(51) Int. Cl.[7] ..... D01G 15/12
(52) U.S. Cl. ..... 19/113; 19/114
(58) Field of Search ..... 19/102, 104, 110, 19/111, 113, 114; 140/97, 100

(56) References Cited

U.S. PATENT DOCUMENTS

| | | | | |
|---|---|---|---|---|
| 564,691 A | * | 7/1896 | Hunton | 19/113 |
| 896,023 A | * | 8/1908 | Kasparson | 19/113 |
| 3,057,020 A | | 10/1962 | Mcleod | |
| 3,936,911 A | | 2/1976 | Roberts | |
| 4,074,392 A | | 2/1978 | Bechtel | |
| 4,221,023 A | | 9/1980 | Henderson et al. | |
| 4,553,288 A | * | 11/1985 | Schneider et al. | 19/113 |
| 5,095,585 A | * | 3/1992 | Grimshaw et al. | 19/113 |
| 2001/0018781 A1 | | 9/2001 | Wurst | |

FOREIGN PATENT DOCUMENTS

| | | |
|---|---|---|
| CH | 676720 A5 | 2/1991 |
| DE | 1 685 600 | 10/1971 |
| DE | 25 44 920 A1 | 4/1976 |
| DE | 33 36 825 A1 | 7/1984 |
| EP | 0 383 479 A1 | 8/1990 |
| EP | 0 567 747 A1 | 11/1993 |
| EP | 0 887 445 A1 | 12/1998 |
| GB | 2 100 305 A | 12/1982 |
| GB | 2 379 939 A | 3/2003 |

OTHER PUBLICATIONS

Steven B. Warner, Fiber Science, Prentice Hall, pp. 130–139.*

* cited by examiner

*Primary Examiner*—Gary L. Welch
(74) *Attorney, Agent, or Firm*—Venable LLP; Robert Kinberg; Stuart I. Smith

(57) ABSTRACT

A device is provided for use in a carding machine having a roller with clothing, the device being for arranging opposite the clothing on the roller. The device has a flat bar, a clothing strip, and a rigid support element connected to the clothing strip and having fastening elements. The fastening elements engage the flat bar and exert pressure on the flat bar.

20 Claims, 6 Drawing Sheets

DEVICE FOR ATTACHING CLOTHING TO A FLAT BAR

CROSS-REFERENCE TO RELATED APPLICATION

This application claims priority to German Patent Application No. 102 14 391.9, filed Mar. 30, 2002, the disclosure of which is incorporated herein by reference.

BACKGROUND OF THE INVENTION

The invention relates to a device on, for example, a carding machine for cotton, synthetic fibers and the like. The device comprises at least one flat bar with flat bar clothing, where the flat bar clothing is attached to the flat bar and is positioned opposite clothing on, for example, a main carding cylinder of the carding machine. The clothing is attached to a support provided with fastening elements that engage the flat bar.

The flat bar of a known device has of a back part and a support body with an underside. A clothing strip (flexible clothing) is attached to the underside (the part that holds the clothing) and extends along the underside. The clothing strip comprises a support element having several textile layers in which a plurality of small wire hooks or clothing needle points are fastened. The clothing strip is attached with the aid of two clamps, straps, or clips along the longitudinal sides of the support body. With one end, the clamps encircle the longitudinal edge regions of the clothing strip and, with the other end, they engage recesses in the support body. In practical operations, the clamps consist of a sheet-metal strip, one longitudinal edge of which is punched into the textile material. During assembly, the textile material of the clothing strip is attached with considerable tension and is form fitting to the support body of the flat bar. In the process, the clamps exert tensile forces in such a way that the textile material is deformed spherically away from the underside. Thus, the clothing needle points are also arranged in an undesirable manner along a convex enveloping curve, pointing toward the outside.

A set of flat bars produced in this way has an accuracy of 0.05 mm in height and evenness when not in use. As a result of use, the height differences in the set will increase to approximately 0.2 mm. The accuracy is improved only insignificantly through a re-sharpening of the clothing on the machine. Following a fiber-material throughput of approximately 400 t, the flat bar clothing is worn to such a degree that it must be replaced. The flat bar is clamped down for dismantling the sheet metal straps and the form-fitting connection is reversed with the aid of a lever and pliers. The considerable forces required for the assembly and dismantling negatively effect the dimensional stability of the flat bar. Added to this are undesirable tolerances resulting from the production of the flat bar body. As a result of the aforementioned disadvantages, the clothing needle points of the clothed flat bar must be leveled by grinding.

According to a previous solution (shown in European Patent 0 887 445), the bottom surface is provided with two side walls that project in a downward direction. The base is not glued directly to the bottom surface, but to a flexible band, wherein this band has side parts that cooperate with the projections on the bottom surface in the manner of clip-on connections, thus fastening the clothing strips to the profile. The side walls are thus extended downward to protect the longitudinal edges of the base. The production of this type of flat bar is expensive with respect to production technology and assembly. In particular, it is problematic that the flexible band does not provide sufficient hold for the clothing strip during operation. The flexibility, which counteracts the important spacing stability between the clothing points of the flat bar clothing and the clothing points on the cylinder clothing, is a disadvantage that results in an uneven carding effect and can also cause operational malfunctions.

SUMMARY OF THE INVENTION

In contrast to the above, it is an object of the invention to create a device of the above-described type that avoids the aforementioned disadvantages. In particular, the invention makes it possible to produce a clothed flat bar with stable form and makes it easier to produce the flat bar and replace the clothing strip.

This and other objects are achieved by a device for use in a carding machine having a roller with clothing, the device being for arranging opposite the clothing on the roller. The device has a flat bar, a clothing strip, and a rigid support element connected to the clothing strip and having fastening elements. The fastening elements engage the flat bar and exert pressure on the flat bar.

Owing to the fact that the support connected to the clothing strip has a rigid design and the fastening elements are elastically connected to the support, an operationally safe embodiment is achieved which also permits easy replacement of worn clothing. If the clothing is worn, the complete unit, including the clothing strip with clothing and support with fastening elements, is removed with few manipulations from the support body and is discarded. Another advantage is that all production tolerances of the flat bar, the clothing as well as those resulting from the assembly (including the dismantling) are eliminated. With the flat bar clothed according to the invention, the addition of tolerances developing during the assembly and dismantling of the flat bar clothing, the technologically damaging leveling and the worsening of the accuracy during use are advantageously and effectively avoided.

BRIEF DESCRIPTION OF THE DRAWINGS

The invention is explained below in further detail with the aid of exemplary embodiments shown in the drawings, wherein.

DETAILED DESCRIPTION OF PREFERRED EMBODIMENTS

Figure 1:
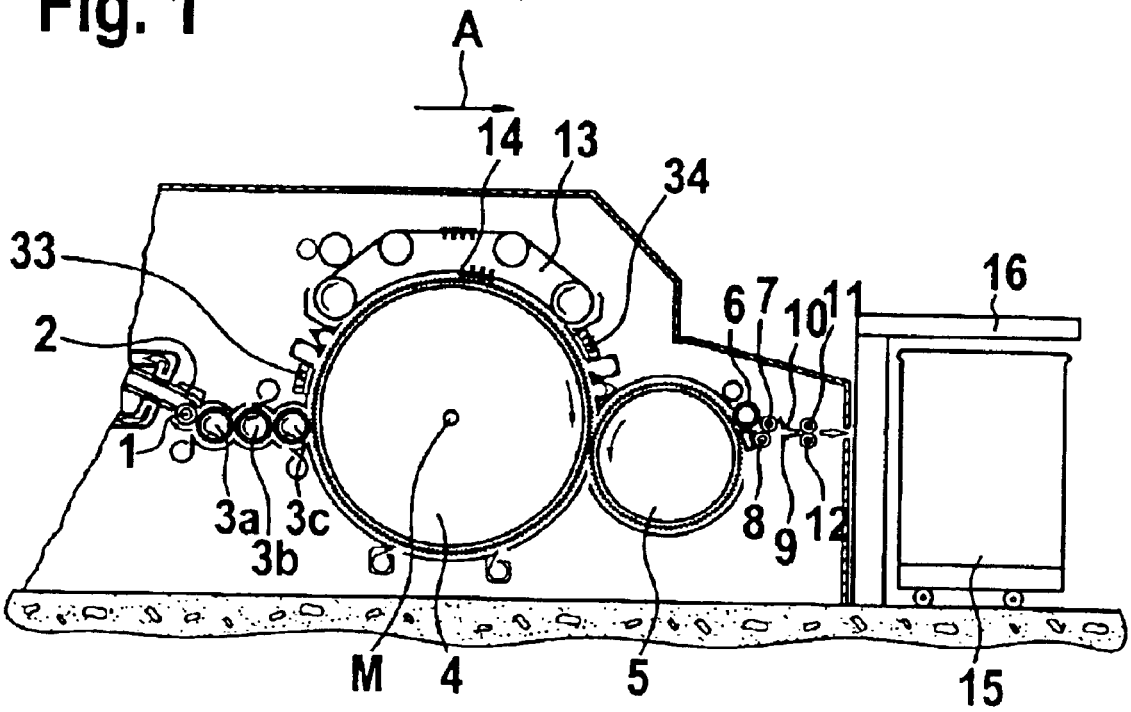
FIG. 1 is a schematic side elevation view of a carding machine with a device according to the invention.

FIG. 1 shows a carding machine, for example a High-Performance Card DK 903 by the company Trützschler in M önchengladbach, Germany. The aforementioned carding machine comprises a feed roller 1, a feed table 2, licker-ins 3*a*, 3*b*, 3*c*, a main carding cylinder 4, a doffer 5, a stripping roller 6, crushing rollers 7, 8, a sliver guide element 9, a web trumpet 10, withdrawing rollers 11, 12, a set of traveling flats 13 with clothed flat bars 14, a can 15 and a sliver coiler arrangement 16. Curved arrows indicate the rotational direction of the rollers while the letter A refers to the operating direction. Stationary carding elements 33 and 34 are arranged opposite clothing of the main carding cylinder 4.

Figure 2:
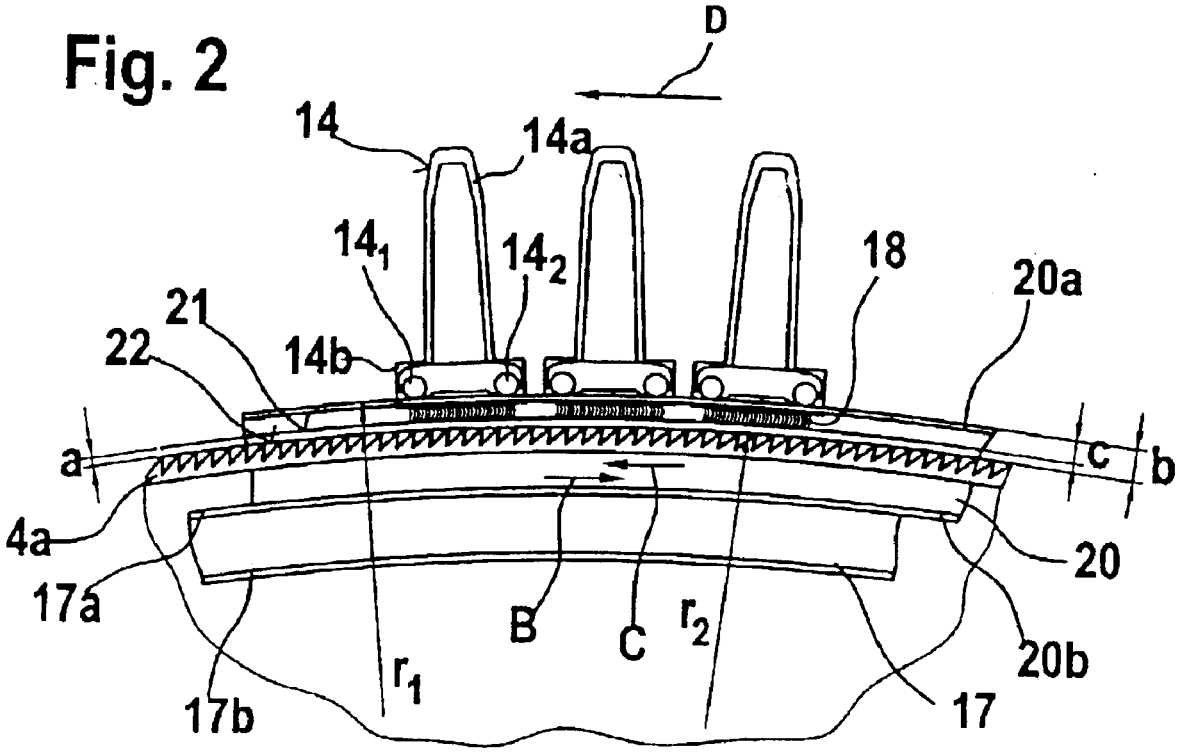
FIG. 2 shows clothed flat bars, a detail of a sliding guide and a flexible bend and the spacing between the flat bar clothing and the cylinder clothing.

FIG. 2 shows a flexible bend 17, provided with several adjustment screws, which is arranged on each side of the carding machine frame. The flexible bend 17 has a convex outside surface 17*a* and an underside 17*b*. A sliding guide 20, for example made of a plastic with sliding ability, with a convex outside surface 20*a* and a concave inside surface 20*b* is provided above the flexible bend 17. The concave inside surface 20*b* rests on the convex outside surface 17*a* and can slide along this surface in the direction of arrows B, C. Each flat bar, for example designed according to European Patent 0 567 747 A1, has a back part 14*a* and a support body 14*b*.

Figure 3A:
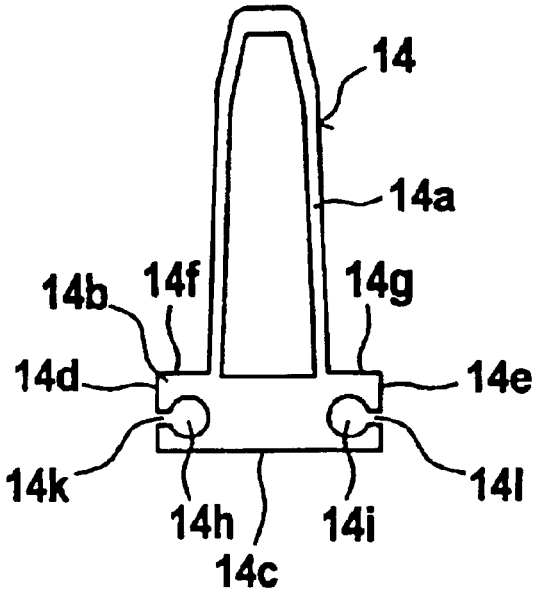
FIG. 3*a* is a sectional view from the side of the flat bar with longitudinal slots.

As shown in FIG. 3*a*, the support body 14*b* has an underside 14*c*, two side surfaces 14*d* and 14*e*, and two top surfaces 14*f* and 14*g*. Each flat bar 14 is provided on its two ends with respectively one flat bar head 14', 14" (see FIG. 9) with respectively two steel pins $\mathbf{14}_1$, $\mathbf{14}_2$ or $\mathbf{14}_3$, $\mathbf{14}_4$ ($\mathbf{14}_1$ and $\mathbf{14}_4$ cannot be seen, but they are behind $\mathbf{14}_2$ and $\mathbf{14}_3$, respectively in FIG. 9). These pins are fastened (for example, glued) with a section (length 1 in FIG. 9) in an axial direction in recesses 14*h*, 14*i* of the support body 14*b*. As shown in FIG. 2, the sections of the steel pins $\mathbf{14}_1$, $\mathbf{14}_2$ that project over the front surfaces of the support body 14*b* slide along the convex outside surface 20*a* of the sliding guide 20 in the direction of arrow D.

A clothing strip 18 is attached to the underside 14*c* of the support body 14*b*. As shown in FIG. 3*c*, clothing strip 18 has a support element 23 of, for example, a textile material and flat bar clothing 19 having a plurality of points. Support element 23 has a thickness f. The flat bar clothing, for example wire needles, 19 extends through the surface of, and are attached in, the support element 23. The points on the other end of the clothing 19 are exposed. A circle 21 defined by the points of the flat bar clothing 19 is shown in FIG. 2. The main carding cylinder 4 is provided along its circumference with a clothing 4*a*, for example a saw-tooth clothing. A circle 22 defined by the points of the cylinder clothing 4*a* is shown in FIG. 2. The distance between the circle 21 and the circle 22, for example, amounts to 3/1000" and is given the reference a. The distance between the convex outside surface 20*a* and the circle 22 is given the reference b. The distance between the convex outside surface 20*a* and the circle 21 is given the reference c. The radius for the convex outside surface 20*a* is $r_1$ and the radius for the circle 22 is $r_2$. The radii $r_1$ and $r_2$ intersect in the center M of the main carding cylinder 4.

According to FIG. 3*a*, the support body 14*b* of the flat bar 14, which is, for example, extruded from aluminum, is provided across its width with two elongated slots 14*k* and 141 that are open toward the outside. These slots widen toward the center of the flat bar 14 to become hollow-cylindrical openings 14*h* and 14*i*. The respective region for fastening the flat bar pins $\mathbf{14}_1$, $\mathbf{14}_2$, $\mathbf{14}_3$, $\mathbf{14}_4$ is shown in the openings 14*h*, 14*i*. A support 26 according to FIG. 3*b*, which is, for example, extruded from aluminum, has a holding element 26*a* and two fastening elements 26*b* and 26*c*. The exposed end regions $\mathbf{26}a_2$ and $\mathbf{26}a_3$ of the holding element 26*a* are bent at a right angle in different directions ($\mathbf{26}a_2$ in a counter-clockwise direction and $\mathbf{26}a_3$ in a clockwise direction). The exposed end regions $\mathbf{26}b_2$ and $\mathbf{26}c_2$ of the holding elements $\mathbf{26}b_1$ and/or $\mathbf{26}c_1$ are bent at a right angle in different directions. They can also be angled respectively to form an acute angle (see FIGS. 5 to 7). The support 26 is preferably formed as a uniform piece of one type of material. The fastening elements 26*b* and 26*c* can also be attached to the holding element 26*a*, for example with the aid of laser welding. The fastening elements 26*b*, 26*c* and the holding element 26*a* can furthermore consist of different materials. The bent regions $\mathbf{26}a_2$ and $\mathbf{26}a_3$ function to additionally hold the support element 23 of the clothing strip 18 (see FIG. 3*c*). As shown in FIG. 3*c*, the clothing strip 18 has clothing points 19 (wire hooks) and a support element 23 of a textile material. The support element 23 has a thickness f. The wire hooks 19 project with one end through the surface of support element 23 and are fastened in the support element 23 while the other end of the wire hooks 19, the clothing points, are exposed.

Figure 3B:
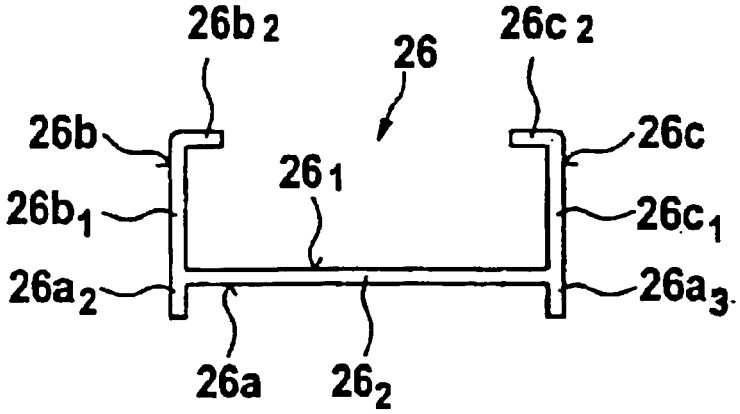
FIG. 3*b* is a view from the side of a support.
Figure 3C:
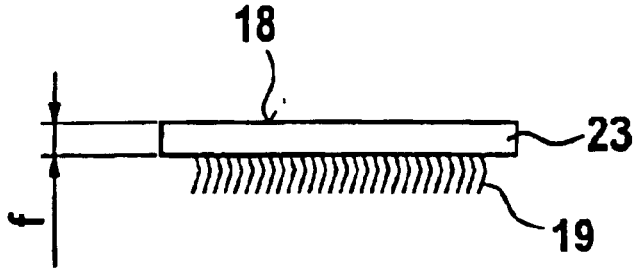
FIG. 3*c* is a sectional view from the side through a clothing strip.
Figure 4:
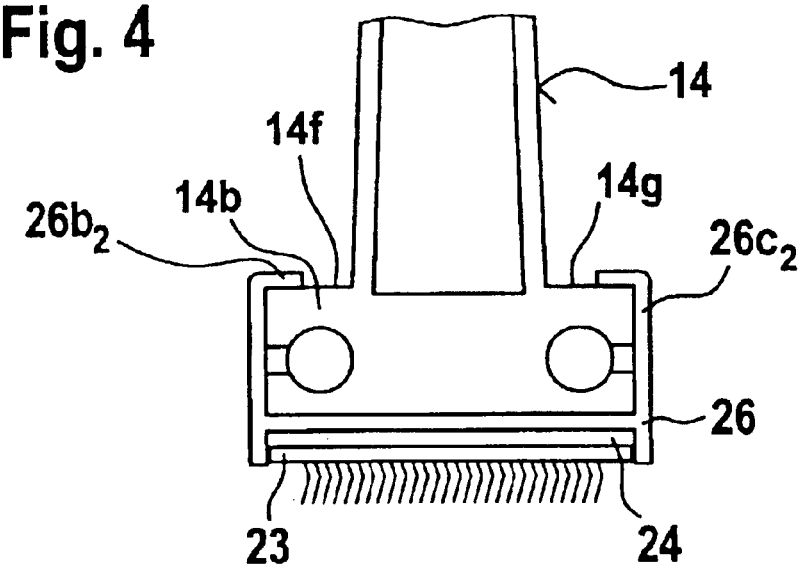
FIG. 4 shows a flat bar with the device according to the invention, in the fully assembled state.

FIG. 4 shows the flat bar 14 according to FIGS. 3*a* to 3*c* in the fully assembled state. The clothing strip 18 is attached to one side $\mathbf{26}_2$ (the inside) of the support 26, for example by gluing it on. The other side $\mathbf{26}_1$ (the outside) of support 26 and the support body 14*b* fit against each other. The end regions $\mathbf{26}b_2$ and $\mathbf{26}c_2$ of the fastening elements 26*b* and 26*c* push against the top surfaces 14*f* and 14*g* of the support body 14*b*, thus attaching the support 26 with clothing strip 18 to the flat bar 14. In addition to the elements shown in FIGS. 3*a* to 3*c*, an intermediate layer 24, for example made of hardened synthetic resin or the like, is installed according to FIG. 4 between the inside surface $\mathbf{26}_2$ of the support and the support element 23. This equalizing layer 24 can equalize differences in the distances between the flat bar 14, namely the bottom surface 14*c*, and the flat bar clothing 19, namely the enveloping curve for the exposed wire needle points.

Figure 5:
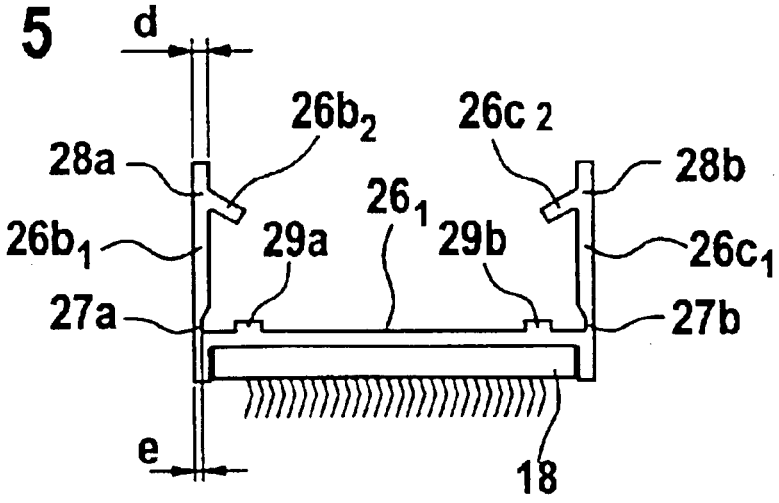
FIG. 5 is a side view of a support which shows an embodiment of the invention with end regions that are formed at an angle and with weakened wall areas.
Figure 5A:
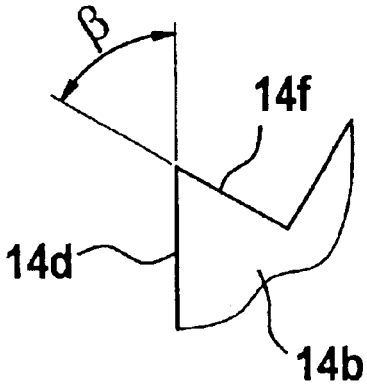
FIG. 5*a* shows upper surfaces of a support body arranged at an acute angle.

According to FIGS. 5 and 5*a*, the exposed end regions $\mathbf{26}b_2$, $\mathbf{26}c_2$ (extensions) are respectively arranged so as to form an acute angle relative to the associated holding elements $\mathbf{26}b_1$ and/or $\mathbf{26}c_1$. Accordingly, the upper surfaces 14*f*, 14*g* of the support body 14*b* are respectively arranged at an acute angle β relative to the associated side surfaces 14*d* and/or 14*e*. The end regions of the holding elements $\mathbf{26}b_1$ and/or $\mathbf{26}c_2$ that face away from the exposed end regions $\mathbf{26}b_2$, $\mathbf{26}c_2$ have a thinner wall thickness e as compared to the wall thickness d of the remaining parts of the holding elements $\mathbf{26}b_1$ and/or $\mathbf{26}c_1$, meaning that both end regions have a weakened wall area 27*a*, 27*b*. It is advantageous if the weakened wall area 27*a*, 27*b* extends over the complete width 1 (see FIG. 9). As a result, the fastening elements 26*b* and 26*c* are elastically attached to the holding element 26*a*. They can be bent inward or outward in the direction of arrows E, F and G, H (see FIG. 7). In addition to the extensions $\mathbf{26}b_2$, $\mathbf{26}c_2$, the holding elements 26*b*, 26*c* also have respectively one extension 28*a* and/or 28*b* with an exposed end, which serve as handles for bending the fastening elements 26*b*, 26*c* inward or outward during the assembly and dismantling operation. Extending in a longitudinal direction, two elongated projections 29*a*, 29*b* are formed onto the surface $\mathbf{26}_1$, which function to realize the spacing between the surface $\mathbf{26}_1$ and the bottom surface 14*c*. The extensions $\mathbf{26}b_2$, $\mathbf{26}c_2$ rest with elastic prestressing on the surfaces 14*f* and/or 14*g*.

Figure 6:
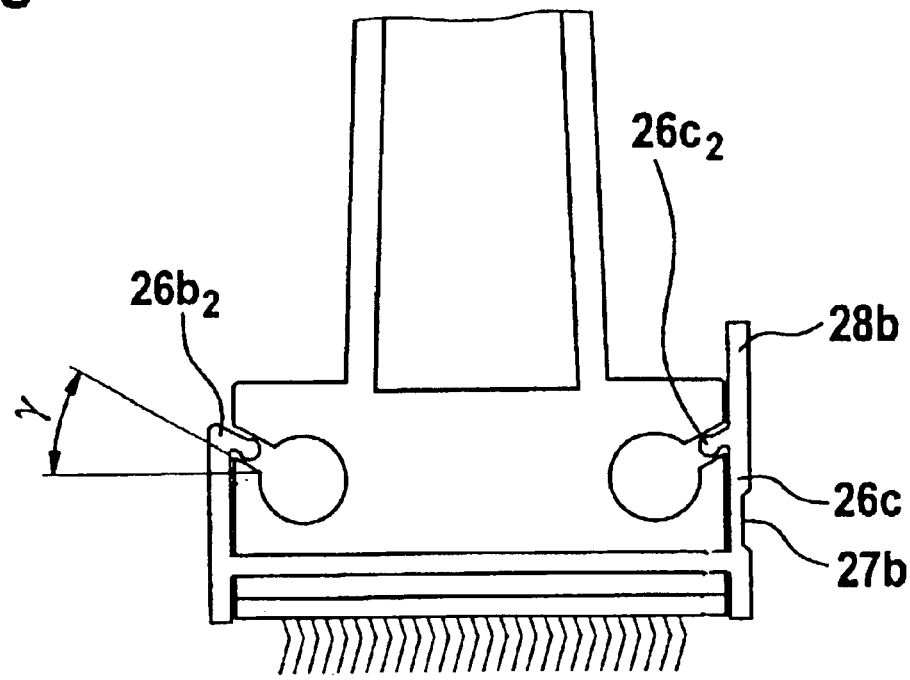
FIG. 6 shows an embodiment of the invention with a holding grip and weakened wall areas.

According to FIG. 6, the lower lips of the longitudinal slots 14*k*, 14*l* are formed with an acute angle γ. The exposed ends of the angled extensions $\mathbf{26}b_2$, $\mathbf{26}c_2$, have thickened areas, which elastically push against the surfaces of the lower lips of longitudinal slots 14*k*, 14*l*. A handle 28*b* for bending the fastening element 26*c* inward or outward is provided. The extension $\mathbf{26}b_2$ is first fitted into the slot 14*k*. Following this, the extension $\mathbf{26}c_2$ is fitted into the slot 14*l* and snapped in. The holder 26*c* has only one weakened area 27*b*.

Figure 7:
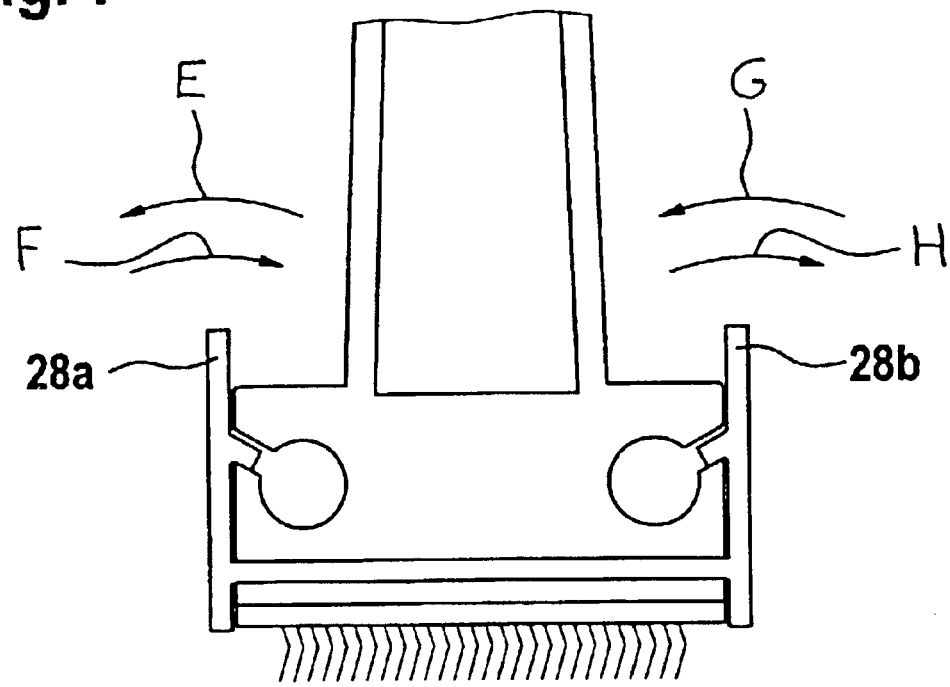
FIG. 7 shows an embodiment of the invention with two holding grips and engagement of the end regions into the longitudinal slots.

FIG. 7 shows an embodiment that is similar to the one shown in FIG. 6, but has two handles 28*a*, 28*b* and does not have thickened areas on the extensions $\mathbf{26}b_2$, $\mathbf{26}c_2$.

Figure 8A:
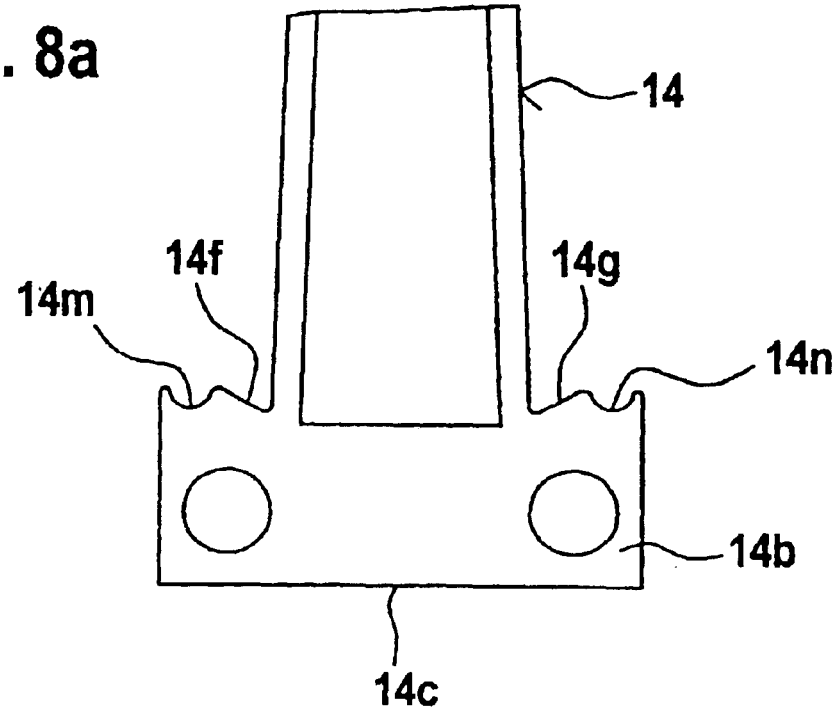
FIGS. 8*a* and 8*b* show an embodiment of a flat bar and a support, respectively, with snap-in or click-in connections.
Figure 8B:
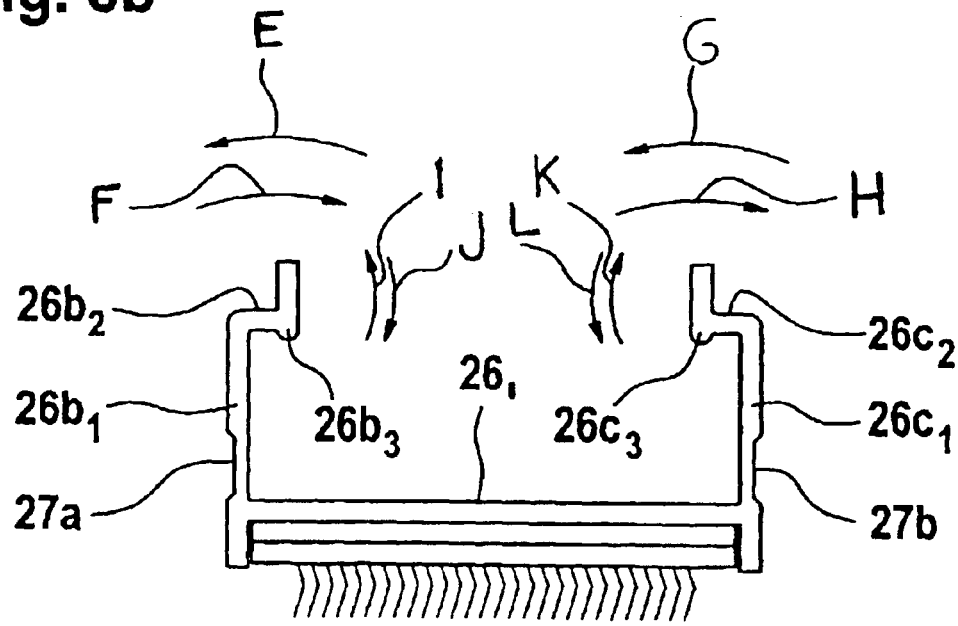

According to FIG. 8*a*, the upper surfaces 14*f* and 14*g* respectively contain groove-shaped recesses 14*m* and/or 14*n*, which extend over the complete length of the flat bar 14, are open on one side and have a curved design in the cross section, for example semi-circular or the like. FIG. 8*b* shows formed-on noses $\mathbf{26}b_3$ and/or $\mathbf{26}c_3$ on the underside of the end regions $\mathbf{26}b_2$, $\mathbf{26}c_2$ (projections) that respectively extend over the length of the holder 26 and have a curved cross-sectional shape, for example semi-circular or the like. When fitted together, the noses $\mathbf{26}b_3$ and $\mathbf{26}c_3$ form-fittingly engage in the corresponding recesses 14*m* and/or 14*n*. In the process, the noses $\mathbf{26}b_3$ and $\mathbf{26}c_3$ exert pressure onto the inside surfaces of the recesses 14*m* and/or 14*n*. For the assembly, the holding elements $\mathbf{26}b_1$ and $\mathbf{26}c_1$ are prestressed in the direction of arrows E and/or H toward the outside as a result of the weakened areas 27*a*, 27*b*. At the same time, the end regions $\mathbf{26}b_2$ and $\mathbf{26}c_2$ are bent "upward" in the direction of arrows I and/or K. The holder 26 is then fitted with its surface $\mathbf{26}_1$, onto the bottom surface 14*c* of the flat bar 14. Following this, the holding elements $\mathbf{26}b_1$ and $\mathbf{26}c_1$ are moved toward the inside, in the direction of arrows F and/or G. At the same time, the end regions $\mathbf{26}b_2$ and $\mathbf{26}c_2$ are bent downward in the direction of arrows J and/or L, wherein the noses $\mathbf{26}b_3$ and $\mathbf{26}c_3$ engage in the recesses 14*m* and/or 14*n*. As a result, the holder 26 is fixedly connected to the flat bar 14 and is locked in place. These operational steps are carried out in reverse during the dismantling of the holder 26 to replace the worn clothing 19.

The holder 26 is attached to the flat bar 14 without additional fastening devices such as screws, clamps and the like. Thus, no additional fastening devices other than the holder 26 and the integrated fastening elements 26*b*, 26*c* exist. A form-fitting connection and elasticity are the physical parameters that determine the fastening system. The one-piece component, consisting of the holder 26 and the fastening elements 26*b*, 26*c*, meets the dual function of fastening the clothing strip 18 to the component and attaching the components to the flat bar 14, such that it can be detached again.

Figure 9:
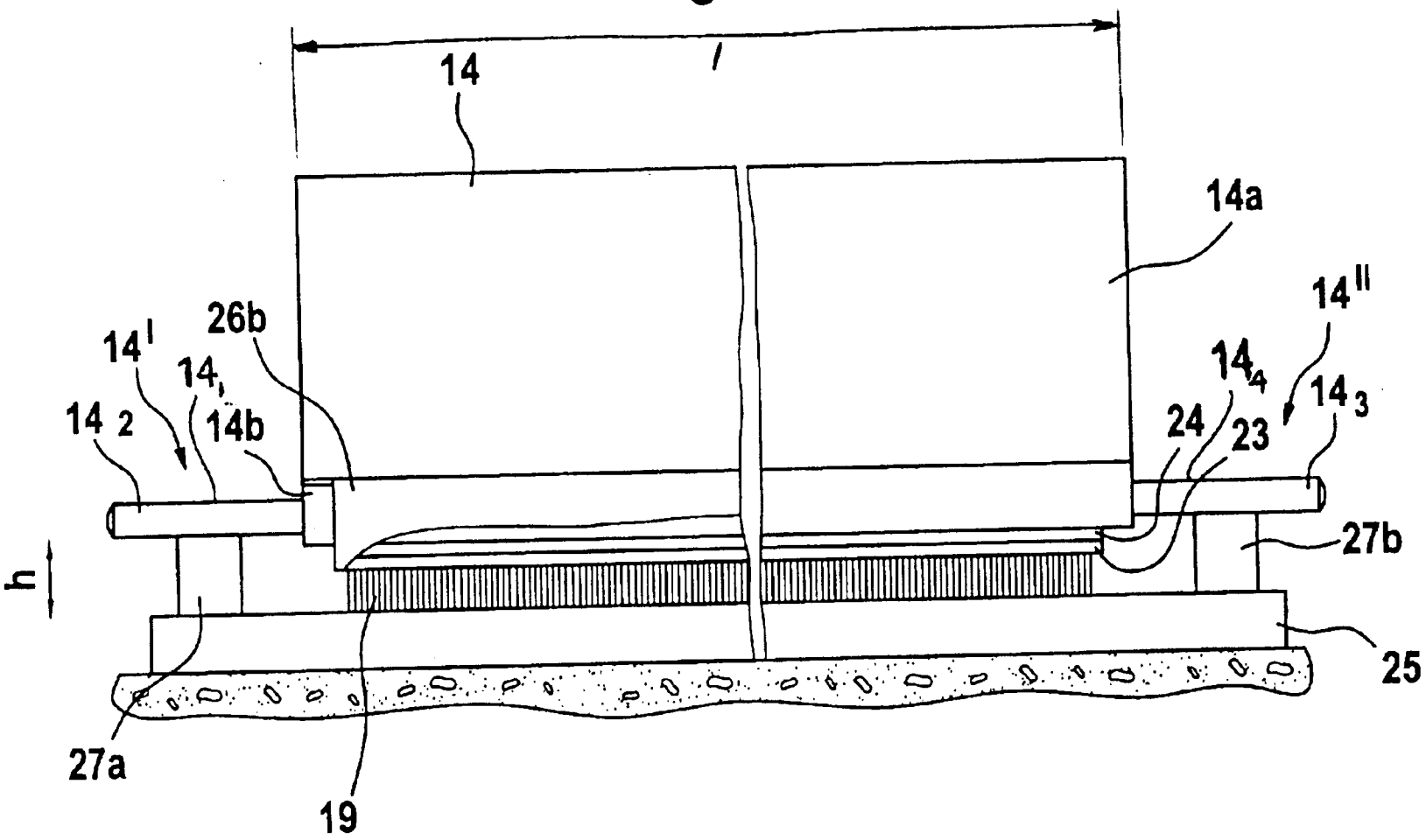
FIG. 9 is a partial sectional view from the side of an embodiment of the invention with a device for aligning the flat bar for depositing an equalizing layer.

FIG. 9 shows that a cube-shaped support element 27*a* with parallel and plane surfaces is arranged between the flat bar pins $\mathbf{14}_1$, $\mathbf{14}_2$ and a level plate 25 and that a second cube-shaped support element 27*b* with the same height h is arranged between the flat bar pins $\mathbf{14}_3$, $\mathbf{14}_4$ and the plate 25 and is locally fixed on the plate 25. With this arrangement and additional (not shown herein) web elements or the like on the side (for example displaceable boundary surfaces for the equalizing layer 24 and/or the support element 23), the clothing points 19 of the clothing strip 18 can be positioned on the plate 25 and the flat bar 14 with pins $\mathbf{14}_1$, $\mathbf{14}_2$, $\mathbf{14}_3$, $\mathbf{14}_4$ can be positioned on the support elements 27*a*, 27*b*. The equalizing layer 24 is subsequently installed between the support 26 and the support element 23, for example through pouring, spraying, spreading, inserting or the like. The equalizing layer 24, for example having a dough-like consistency, expands in this intermediate space so as to equalize this space.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A device for use in a carding machine, the carding machine having a roller with clothing, the device being for arranging opposite the clothing on the roller, the device comprising:

a flat bar;

a clothing strip; and a rigid support connected to the clothing strip and having fastening elements, the fastening elements engaging the flat bar, wherein the fastening elements exert pressure on the flat bar and at least one of the fastening elements has a weakened section as compared to the remaining sections of the fastening element to facilitate elastic bending at the weakened section.

2. The device according to claim 1, wherein the fastening elements are connected elastically to the support.

3. The device according to claim 2, wherein the support engages the flat bar through spring-back of the fastening elements.

4. The device according to claim 3, wherein the fastening elements are held in place through spring-back.

5. The device according to claim 1, wherein the support can be disengaged by bending the fastening elements m an outward direction.

6. The device according to claim 5, wherein the support can be engaged by bending the fastening elements inward.

7. The device according to claim 6, wherein the fastening element comprises an extension.

8. The device according to claim 7, wherein the extension engages in a projection of a shoulder on the flat bar.

9. The device according to claim 8, wherein the extension elastically engages in the projection of the shoulder.

10. The device according to claim 9, wherein the extension is elastically connected to the support.

11. The device of claim 10, wherein the extension is elastically connected to a holder of the fastening element.

12. The device according to claim 1, wherein the support has an essentially beveled U-shaped profile in cross section.

13. The device according to claim 12, wherein legs of the U-shaped profile and the holders of the fastening elements are aligned.

14. The device according to claim 13, wherein inside surfaces of the legs of the U-shaped profile and longitudinal surfaces of the clothing strip are located opposite each other.

15. The device according to claim 1, wherein the fastening elements engage in the flat bar via a snap-in connection.

16. The device according to claim 1, wherein the fastening elements form locking means.

17. The device according to claim 1, wherein the support and the fastening elements together form one piece made of the same material.

18. The device according to claim 1, wherein the fastening elements extend essentially over a length of the flat bar.

19. The device according to claim 1, further comprising a gripping portion extending beyond at least one of the fastening elements in a direction away from the clothing strip, the gripping portion being for gaining leverage to bend the fastening element to remove the pressure exerted on the flat bar.

20. A device for use in a carding machine, the carding machine having a roller with clothing, the device being for arranging opposite the clothing on the roller, the device comprising:

a flat bar a clothing strip; and a rigid support connected to the clothing strip and having fastening elements, the fastening elements engaging the flat bar, wherein the fastening elements exert pressure on the flat bar, the support can be disengaged by bending the fastening elements in an outward direction, the support can be engaged by bending the fastening elements inward, each fastening element comprises an extension, the extension elastically engages in a projection of a shoulder on the flat bar, the extension is elastically connected to the support, the extension is elastically connected to a holder of the fastening element, and the elasticity is achieved through a weakened area of the holder of the fastening element.

* * * * *